US007534149B2

(12) United States Patent
Williams et al.

(10) Patent No.: US 7,534,149 B2
(45) Date of Patent: May 19, 2009

(54) PLUGLESS NORMALLY-OPEN CONNECTOR MODULE

(75) Inventors: Doug Williams, Omaha, NE (US); William C. Clark, Lee's Summit, MO (US)

(73) Assignee: Commscope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/965,697

(22) Filed: Dec. 27, 2007

(65) Prior Publication Data

US 2008/0124986 A1 May 29, 2008

Related U.S. Application Data

(63) Continuation of application No. 11/564,278, filed on Nov. 28, 2006, now Pat. No. 7,335,069.

(51) Int. Cl.
*H01R 11/20* (2006.01)

(52) U.S. Cl. ..... 439/709; 439/404; 439/934

(58) Field of Classification Search ..... 439/709, 439/404, 934, 188, 718
See application file for complete search history.

(56) References Cited

U.S. PATENT DOCUMENTS

| | | | | |
|---|---|---|---|---|
| 3,798,587 | A | 3/1974 | Ellis, Jr. et al. | |
| 4,171,857 | A | 10/1979 | Forberg et al. | |
| 4,283,103 | A | 8/1981 | Forberg et al. | |
| 4,795,374 | A | 1/1989 | Rishworth et al. | |
| 5,549,489 | A | 8/1996 | Baggett et al. | |
| 5,575,689 | A | 11/1996 | Baggett et al. | |
| 5,618,199 | A * | 4/1997 | Conorich et al. | 439/404 |
| 5,634,014 | A | 5/1997 | Gist et al. | |
| 5,647,760 | A * | 7/1997 | Drach et al. | 439/395 |
| 5,816,830 | A | 10/1998 | Griffith et al. | |
| 6,994,582 | B1 | 2/2006 | Carney et al. | |
| 7,052,307 | B2 * | 5/2006 | Kim et al. | 439/404 |

* cited by examiner

*Primary Examiner*—Gary F. Paumen
(74) *Attorney, Agent, or Firm*—Muncy, Geissler, Olds & Lowe, PLLC

(57) ABSTRACT

A connector module, which permits termination of cross-connect wires on one surface and cable wires on an opposite surface, has an internal switch configuration which is normally open, such that the cross-connect wires are normally not connected to the cable wires. The module exhibits a generally "Z" shaped configuration which permits test access, jumper insertion, and protector mounting on either surface.

21 Claims, 5 Drawing Sheets

PLUGLESS NORMALLY-OPEN CONNECTOR MODULE

This application is a continuation of prior application Ser. No. 11/564,278, filed Nov. 28, 2006 now U.S. Pat. No. 7,335,069.

BACKGROUND OF THE INVENTION

1. Field of the Invention

The present invention relates to connector modules for electrically connecting sets of wires.

2. Description of the Related Art

In the telecommunications industry, connecting blocks comprising an array of insulation displacement contacts are typically used in telephone central offices, building entrance terminals, and outside plant cabinets for electrical connection between cables and cross-connect wiring. One example of such a connecting block is the standard 110-type connector block. See, for example, U.S. pat. No. 3,798,587, issued to Ellis, Jr. et al., which is hereby incorporated by reference.

Such connector blocks include rows of insulation displacement contacts mounted within a plastic module. Each contact includes insulation piercing slots on both ends. One set of wires is placed within a (index) strip, and the contact module is placed over the wires in order to make contact therewith. A second set of wires is inserted into the opposite end of the contacts to complete the electrical connection between the sets of wires.

In some more recent systems, connector modules include slots for mounting protectors which are electrically connected to the contacts. See, for example, U.S. Pat. Nos. 4,171,857 and 4,283,103 issued to Forberg et al., which are hereby incorporated by reference. While the prior art connector blocks are adequate, wiring was generally done on a single surface, and when protector components were also mounted on the connector block, it was necessary to remove the protectors before inserting jumper wires or test probes.

U.S. Pat. Nos. 5,549,489 and 5,575,689 issued to Baggett et al., which are hereby incorporated by reference, addressed this drawback and show a connector module which permits wiring on two surfaces and insertion of patch cords or test leads into one surface while a protector component is mounted on the opposite surface. In such modules, the protector remains connected to a contact in the module via a slot on one side of the module, while a test probe is inserted into a slot on the opposite side of the module to make an electrical connection with the contact in the block, such that protection is not interrupted as the test probe is inserted.

The connector module of Baggett et al. has a "make-before-break"capacity so that signaling is not interrupted when a protector, a patch cord or test access lead is inserted into a slot of the module. In other words, the module functions as a normally closed switch, wherein the wires of the incoming cables are normally connected to the cross-connect wiring of the building. protectors, test leads, and patch cords may be electrically connected to the contacts within the module (via the slots) without interrupting the electrical connection between the wires of the incoming cable and the cross-connect wires of the building.

SUMMARY OF THE INVENTION

Applicants have appreciated a drawback of the module disclosed in U.S. Pat. Nos. 5,549,489 and 5,575,689. In certain situations, it is desirable to have a connector module which functions as a normally open switch, wherein the wires of the incoming cables are normally disconnected from the cross-connect wiring of the building. In other words, the connector module requires the presence of a conductive lead (such as a protector) inserted into a slot of the module to electrically connect the wire of the incoming cable to the cross connect wire of the building.

Applicants have appreciated that non-conductive leads may be inserted into a first row of slots of the connector module to disconnect all of the wires of the incoming cables from the cross-connect wiring of the building. Then, electrically conductive leads of protectors may be inserted in select slots of the second row of slots where it is desired to connect the particular incoming wire to the particular cross connect wire of the building. Such a use of the slots illustrated in U.S. Pat. Nos. 5,549,489 and 5,575,689 results in "normally-open" connections between the wires of the incoming cable and the cross connect wires of the building (by virtue of the non-conductive leads inserted into all of the slots of the first row of slots) and permits the user to selectively connect wires of the incoming cable to the building's cross connect wires by virtue of inserting protectors into select slots of the second row of slots.

However, this solution has a drawback. Namely, the slots of the first row of slots are used to accommodate the insulting leads needed to separate the stem portions of the contacts. Therefore, if a user wishes to insert a test probe or jumper lead into the connector module, the protector must be removed from its slot in the second row of slots, so as to provide access to the stem portions for the test probe or jumper lead. Therefore, protection to the circuit must be removed, prior to the connection, which is an undesirable event.

It is an object of the present invention to address one or more of the drawbacks associated with the background art.

It is a further object of the present invention to provide a connector module which is "normally open" as to its connection between the wires of an incoming cable and cross connect wires of a building, yet has two slots to access the internal stem portions of the contacts for each connection.

It is an object of the present invention to provide a normally open connector module which is easy and inexpensive to fabricate.

It is an object of the present invention to provide a normally open connector module which can fit into existing holders for normally closed connector modules, and which is connected to the wires of incoming cables and cross connect wires of the building in an identical fashion as existing normally closed connector modules, so as to reduce the training required by technicians to use the normally open connector module.

These and other objects are accomplished by a connector module, which permits termination of cross-connect wires on one surface and cable wires on an opposite surface, having an internal switch configuration which is normally open, such that the cross-connect wires are normally not connected to the cable wires. The module exhibits a generally "Z" shaped configuration which permits test access, jumper insertion, and protector mounting on either surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF A PREFERRED EMBODIMENT

Figure 1:
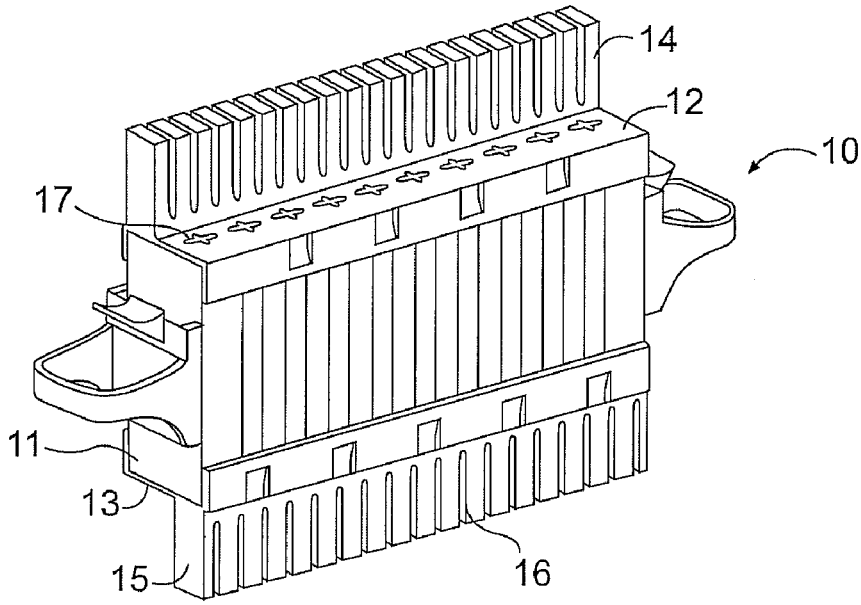
FIG. 1 is a perspective view of a connector module, in accordance with an embodiment of the invention.

FIG. 1 illustrates a connector module 10 which can be inserted into a mounting frame (not shown) along with other similar modules 10 to form a connecting block. For details concerning the mounting frame see U.S. Pat. No. 5,595,507, issued to Braun et al., which is incorporated herein by reference.

The module includes a housing which is made of electrically insulating material, such as plastic. The housing includes an essentially rectangular body portion 11 which is covered by a top cap 14 and a bottom cap 15. The caps 14 and 15 can be made of the same material as the housing and define an upper surface 12 and a lower surface 13 of the housing, respectively.

Each cap 14 and 15 includes a series of slits 16, which permit insertion of a wire (such as wires 60 and 61 of FIG. 4) therein, as discussed below. Top cap 14 includes a series of slots 17 in the top surface 12. Bottom cap 15 includes a series of slots 18 (see FIG. 4) in the bottom surface 13. The slots 17 and 18 permit insertion of leads 19, 40 and 41 (see FIGS. 5, 6 and 10), which may be electrically coupled to a single protector 21 (see FIG. 5), a cartridge of protectors 20 (see FIG. 10), a test probe 22 (see FIG. 6), a patch cord, or possibly other components.

Figure 2:
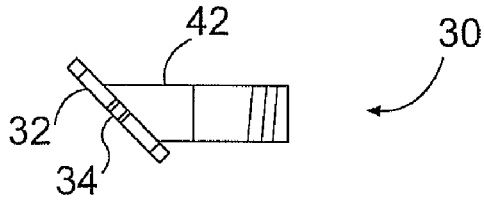
FIGS. 2 and 3 are top and side views, respectively, of a contact in accordance with a first embodiment of the present invention.
Figure 3:
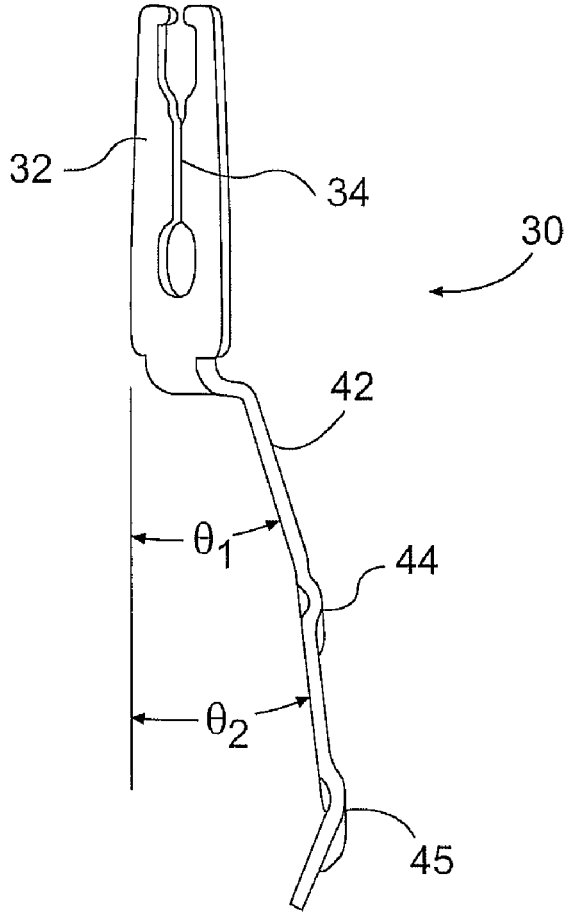
Figure 6:
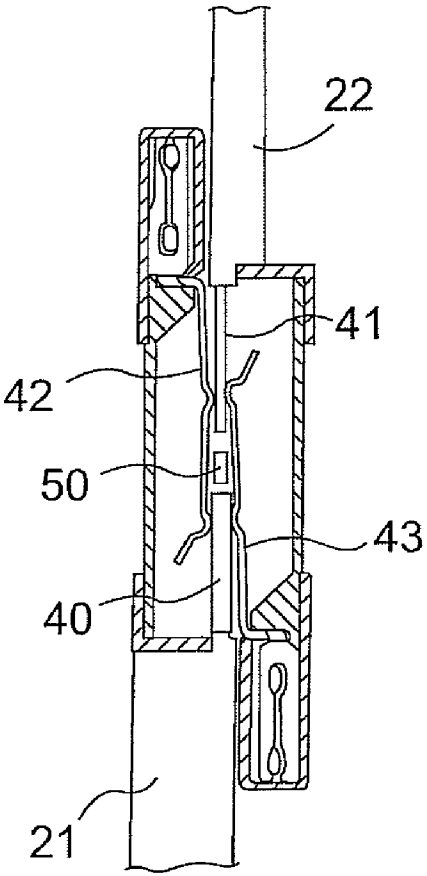
FIGS. 4-6 are cross-sectional views of a connector module employing the contacts of FIGS. 2 and 3.
Figure 5:
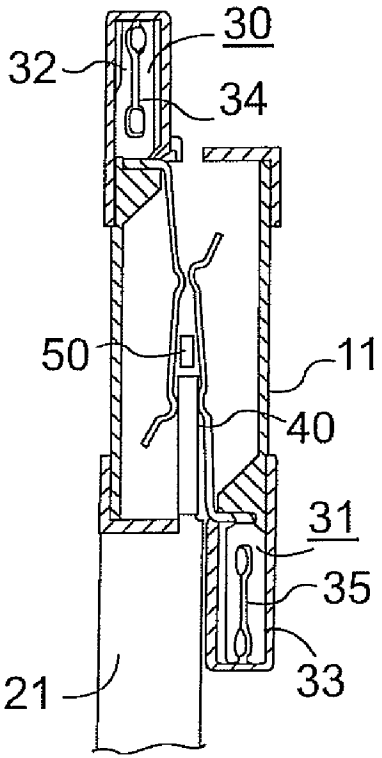
Figure 4:
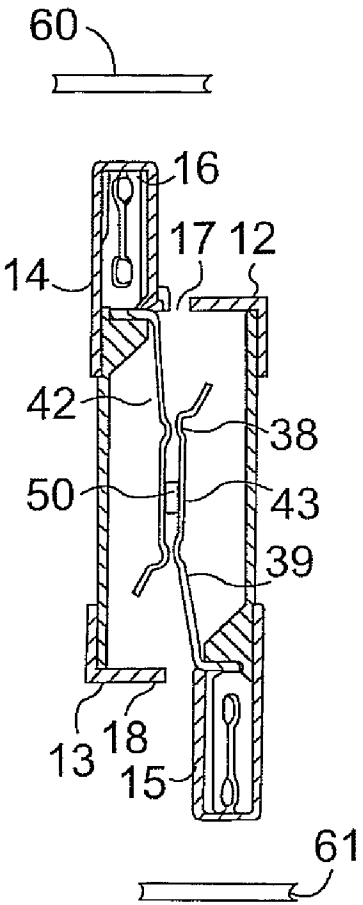

As illustrated in FIGS. 4-6, mounted within the housing is a first row of contacts 30 and a second row of contacts 31. In one embodiment, the contacts 30 and 31 are identical in structure. FIGS. 2 and 3 illustrate the particular structure of the contact 30.

Each contact 30 and 31 includes an end portion 32 and 33, respectively, which is capable of providing electrical connection to a wire 60 and 61, respectively. In this embodiment, the end portions 32 and 33 each comprise a slot 34 and 35, which pierces the insulation surrounding the wire to establish electrical contact, as the wire is inserted to a proper depth. The contacts 30 and 31 are mounted so that the end portions 32 of the first row of contacts 30 protrude through the top surface 12 of the housing, while the end portions 33 of the second row of contacts 31 protrude through the bottom surface 13 of the housing. As best seen in FIGS. 4-6, the end portions 32 are not vertically aligned with the end portions 33, but rather are laterally displaced relative to the end portions 33. The end portions 32 and 33 are also aligned with corresponding slits 16 in the top and bottom caps 14 and 15, so that wires 60 and 61 may be inserted through the slits 16 in the top and bottom caps 14 and 15 for electrical connection to the end portions 32 and 33, respectively.

The remainders of the contacts 30 and 31 (besides the end portions 32 and 33) are known as the stem portions 42 and 43, respectively. The stem portions 42 and 43 extend into the body portion 11 of the housing. As illustrated in FIG. 2, the faces of the end portions 32 and 33 are advantageously disposed at an angle of approximately 45 degrees with respect to a plane of the stem portions 42 and 43. As illustrated in FIG. 3, the stem portion 42, 43 of each contact 30, 31 extends from the end portion 32 and 33 at a first angle $\theta_1$ from an edge of the end portion in the plane of the longitudinal axis, and further down the stem, extends at a second angle $\theta_2$ from the edge of the end portion.

In this illustrated example, $\theta_1$ is 17 degrees and $\theta_2$ is 2 degrees. Typically, $\theta_1$ is in the range of 10 to 20 degrees, while $\theta_2$ is in the range −10 to +20 degrees. Use of a double angle can be advantageous in narrowing the width of the body portion 11 of the housing, by permitting the end portions to be placed closer together. However, stem portions 42 and 43 disposed at a single angle relative to the end portion 32,33 may be employed. It will be appreciated that the contacts 30 and 31 in the first and second rows may be identical, but oriented in opposite directions.

The stem portions 42 and 43 each include a pair of raised portions 44 and 45, which may be plated with a precious metal or alloy to provide an improved electrical contact point. As illustrated in FIGS. 4-6, these raised portions 44 and 45 can establish two potential points of electrical contact 38 and 39 for each stem portion 42, 43 with an electrical lead.

Each top point of contact 38 (produced by raised portion 44 in the first row of contacts 30 and produced by raised portion 45 in the second row of contacts 31) is aligned with a slot 17 in the top surface 12 of the housing. Each bottom point of contact 39 (produced by raised portion 45 in the first row of contacts 30 and produced by raised portion 44 in the second row of contacts 31), is aligned with a slot 18 in the bottom surface 13 of the housing.

As illustrated in FIG. 4, the top point of contact 38 produced by the raised portion 44 on the stem portion 42 of the contact 30 in the first row of contacts does not normally physically or electrically contact the top point of contact 38 produced by the raised portion 45 on facing corresponding stem portion 43 of the contact 31 in the second row of contacts. This is because the connector module of the present invention is a "normally open" connector module by design. The angles $\theta_1$ and $\theta_2$ of the stems portions 42 and 43 may be set such that facing stem portions 42 and 43, as illustrated in FIG. 4 do not contact each other in an electrical sense or physical sense.

Alternatively, or in additional to the angle selections $\theta_1$ and $\theta_2$, a spacer 50 may be placed between the stem portions 42 and 43. The spacer 50 would be formed of an electrically non-conductive material, such as plastic. The spacer 50 could be a part of the housing which is formed integrally with the housing during the initial molding process of the housing or could be later welded to the housing. In one embodiment, separate spacers 50 would be welded into each chamber, housing each facing set of stem portions 42 and 43. In another embodiment, the spacer 50 would extend between the side walls of the body portion 11 of the housing in a direction parallel to the row of slots 17 in the top surface 12, and would be located in a top-to-bottom middle section of the body portion 11 (halfway between the top surface 12 and bottom surface 13), and in a front-to-back middle section of the body portion 11 (halfway between the first row of slots 17 and the second row of slots 18, which are laterally displaced as can be seen in FIGS. 4-6).

As illustrated in FIG. 4, the stem portions 42 and 43 would physically contact the spacer 50 in their normal state, and the spacer 50 would prevent any electrical connection between the facing stem portions 42 and 43.

As illustrated in FIG. 5, when a lead 40, coupled to a protector 21, (or to a patch cord), is inserted into a bottom slot 18, it will initially push apart the facing stem portions 42 and 43 at the lower contact point 39, aligned with the slot 18. The stem portions 42 and 43 at the upper contact point 38 will continue to remain disconnected. It will be appreciated that the same principles operate in reverse if the lead 40 were inserted from the top slot 17. In either circumstance, i.e., insertion from the bottom slot 18 or the top slot 17, current between the contacts 30 and 31 will flow only through the protector 21.

FIG. 6 illustrates providing test access to the contacts 30 and 31. As illustrated in FIG. 6, a lead 41 is attached to a test cord 22 and is inserted into a top slot 17 on the top surface 12 of the housing. The test lead 41 will slightly push apart the facing stem portions 42 and 43 at the upper point of contact 38. However, due to the bending angles $\theta_1$ and $\theta_2$ and moments previously described, the stem portions 42 and 43 will remain in contact with the lead 40 of the protector 21 to continue to provide protection to the cable wires 60 and cross connect wires 61 and the circuitry attached thereto (not shown).

Of course, it would be possible to make the lead 41 of the test cord 22 oversized in one or both directions (i.e. toward stem portion 42 and/or toward stem portion 43), so as to displace the stem portion 42 away from lead 40 and/or to displace the stem portion 43 away from the lead 40, if it were desired to test the circuitry in electrical isolation from the circuit protector 21 without actually having to unplug the circuit protector 21 from the second slot 18. For a further discussion of such a modified lead 41, reference can be had to U.S. Pat. No. 5,549,489, as previously incorporated by reference.

Figure 7:
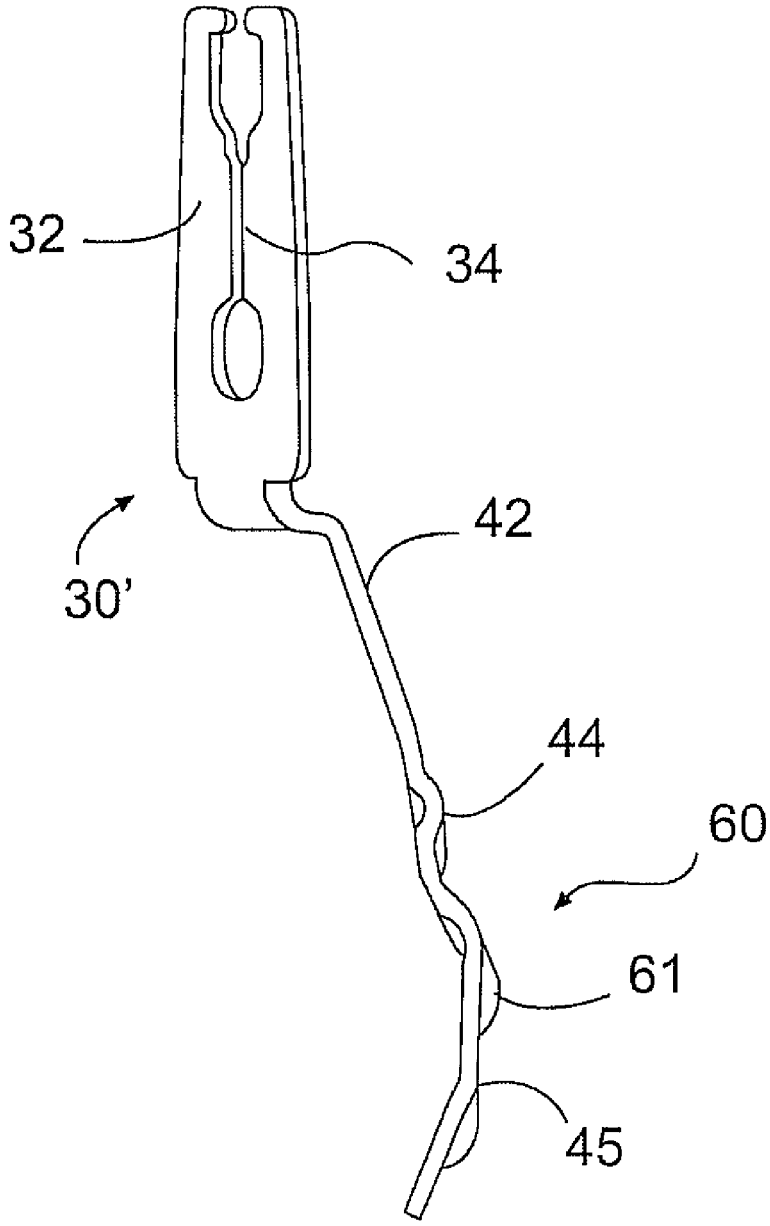
FIG. 7 is a side view of a contact, in accordance with a second embodiment of the present invention.

FIG. 7 is a side view of a contact 30', in accordance with a second embodiment of the present invention. The contract 30' is the same as the contact 30 illustrated in FIG. 3 except that a non-conductive portion 60 is included. The non-conductive portion 60 may be formed as a curved portion similar in shape to the raised portions 44 and 45 on the stem portion 42, and slightly larger in size. A non-conductive coating 61, such as plastic or paint, is applied to the outer convex surface of the curved portion to form the non-conductive portion 60 of the stem portion 42.

The non-conductive portion 60 is intended to physically engage a facing corresponding stem portion 43 to ensure a spacing between raised portions 44 and 45 and hence the upper and lower contact points 38 and 39 of the facing stem portions 42 and 43. By employing the non-conductive portions 60, the spacer 50 may be eliminated, such that the body portion 11, the top cap 14 and the bottom cap 15 of the housing may be formed in the same manner as illustrated in U.S. Pat. No. 5,549,489. Hence, there would be a savings in design and fabrication costs.

In one embodiment of the present invention, only one stem portion 42 includes the curved portion with the non-conductive coating 61 to form the non-conductive portion 60. The other stem portion 43 would remain as depicted in FIGS. 2 and 3. In another embodiment of the present invention, both contacts 30 and 31 would be identically structured, such that both stem portions 42 and 43 would include a non-conductive portion 60. Again, it is believed that a cost savings would occur if the contacts 30 and 31 were identical in structure.

Figure 9:
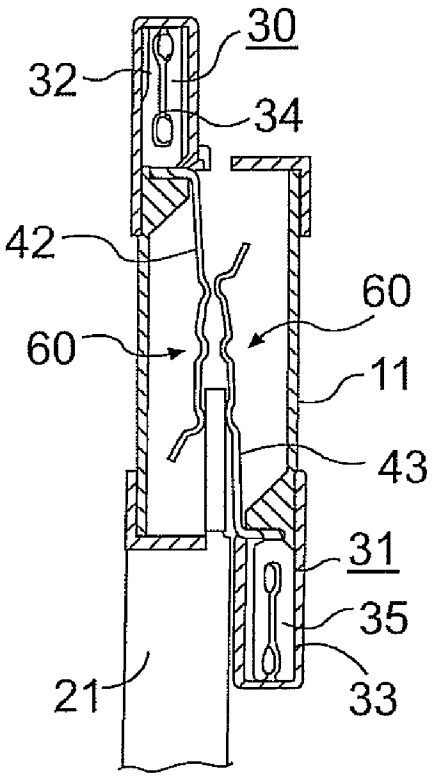
FIGS. 8-9 are cross-sectional views of a connector module employing the contacts of FIG. 7.
Figure 8:
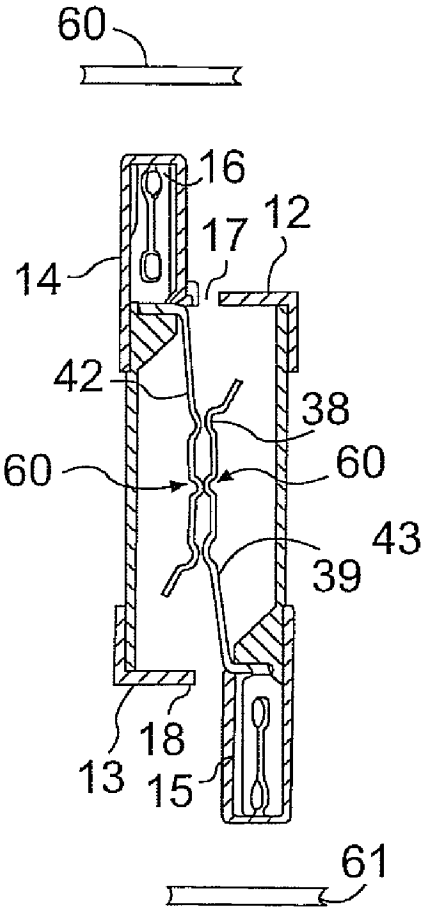

FIGS. 8 and 9 are similar to FIGS. 4 and 5, but illustrate the non-conductive portions 60 replacing the spacer 50. As can be seen in FIGS. 8 and 9, the non-conductive portions 60 face each other and physically contact each other in the "normally open" state of the connector module. FIG. 9 shows the lead 40 of the protector 21 being inserted into a bottom slot 18. The operation of the components of FIGS. 8 and 9 would be the same as the operation of the components of FIGS. 4 and 5, except for the elimination of the spacer 50 and the replacement of its functionality by the non-conductive portions 60 of the stem portions 42 and 43.

Figure 10:
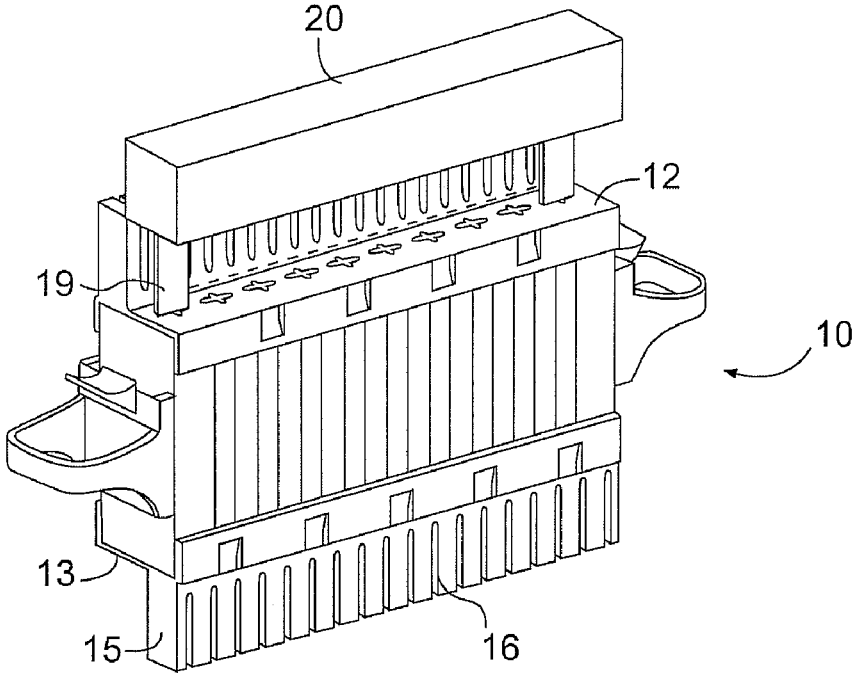
FIG. 10 is an exploded perspective view of the module of FIG. 1 in combination with a protector cartridge.

FIG. 10 is an exploded perspective view of the module of FIG. 1 in combination with a protector cartridge 20. Instead of inserting individual protector units 21, as illustrated in FIGS. 5 and 6, the user may insert a protector cartridge 20 including a plurality of gas tube protectors. In either case, the protectors 21 or 20 can remain in place when it is desired to insert a lead 41 of a test probe 22 or a jumper cable in the slots of opposite surface of the connector module. There is no necessity of removing the protectors in order to free up the slot to insert a lead 41 of a test probe 22 or a jumper cable, as was previously the case when the other row of slots accommodated insulating leads to separate the stem portions 42 and 43.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A connector module comprising:

a housing;

first and second sets of contacts mounted within said housing, each contact including a terminal portion which is capable of providing electrical connection to a corresponding wire and a stem portion, said contacts being mounted so that each stem portion of said first set of contacts faces a corresponding stem portion of said second set of contacts without making electrical contact with the corresponding stem portion of said second set of contacts; and at least one slot formed in said housing for receiving therein a lead which can electrically connect the stem portion of one of said first set of contacts to the corresponding stem portion of said second set of contacts.

2. The connector module according to claim 1, wherein said at least one slot includes:

a first set of slots formed in said housing, each slot for receiving therein a lead which can electrically connect the stem portion of one of said first set of contacts to the corresponding stem portion of said second set of contacts; and a second set of slots formed in said housing, each slot for receiving therein a lead which can electrically connect the stem portion of one of said first set of contacts to the corresponding stem portion of said second set of contacts.

3. The connector module according to claim 1, further comprising:

a spacer provided in said housing between corresponding stem portions of said first and second sets of contacts, wherein said spacer is formed of an electrically insulating material and ensures that facing stem portions of said first and second sets of contacts do not make electrical contact with each other.

4. The connector module according to claim 3, wherein said spacer is a part of said housing.

5. The connector module according to claim 1, wherein each terminal portion of each contact includes an insulation piercing slot.

6. The connector module according to claim 2, wherein said housing includes a first surface and a second surface and said second surface of said housing is opposite to said first surface of said housing.

7. The connector module according to claim 6, wherein said first set of slots are formed in said first surface of said housing and said second set of slots are formed in said second surface of said housing.

8. The connector module according to claim 6, wherein said terminal portions of said first set of contacts are laterally displaced on said first surface of said housing as compared to a placement of said terminal portions of said second set of contacts on said second surface of said housing.

9. A connector module according to claim 2, further comprising:

a protector component with at least one lead inserted into a slot of said first and second sets of slots.

10. A connector module according to claim 6, wherein said housing includes:

a first insulating cap placed over said first surface of said housing, said first insulating cap including a first set of slits aligned with said terminal portions of said first set of contacts to permit wires to be inserted therein for making electrical connection with said terminal portions of said first set of contacts; and a second insulating cap placed over said second surface of said housing, said second insulating cap including a second set of slits aligned with said terminal portions of said second set of contacts to permit wires to be inserted therein for making electrical connection with said terminal portions of said second set of contacts.

11. A connector module according to claim 10, wherein said first set of slots are formed in said first insulating cap, and said second set of slots are formed in said second insulating cap.

12. A connector module according to claim 2, wherein each stem portion of said first and second sets of contacts has two potential electrical contact points, including a first electrical contact point being aligned with a slot of said first set of slots and a second electrical contact point being aligned with a slot of said second set of slots.

13. A connector module according to claim 12, wherein said electrical contact points include raised surfaces of said stem portions.

14. A connector according to claim 13, wherein said raised surfaces are coated with a conductive material.

15. A connector module according to claim 1, wherein at least one stem portion of facing corresponding stem portions of the said first and second sets of contacts includes a non-conductive portion which physically engages the other corresponding stem portion to ensure a spacing between conductive portions of the facing corresponding stem portions.

16. A connector module according to claim 15, wherein said non-conductive portion includes a non-conductive material applied to a raised portion of said at least one stem portion.

17. A connector module according to claim 1, wherein each stem portion of said first and second sets of contacts has a non-conductive portion, wherein said non-conductive portion includes a non-conductive material, which physically touches another non-conductive portion of a facing, corresponding stern portion.

18. A connector module comprising:

an insulating housing having a top surface and a bottom surface;

first and second sets of contacts mounted within said housing, each contact including a terminal portion which is capable of providing electrical connection to a corresponding wire and a stem portion, said contacts being mounted so that said terminal portions of said first set of contacts are located adjacent said top surface and said terminal portions of said second set of contacts are located adjacent said bottom surface, and said contacts being mounted so that each stem portion of said first set of contacts faces a corresponding stem portion of said second set of contacts without making electrical contact with the corresponding stern portion of said second set of contacts;

a first set of slots formed in said top surface aligned with said terminal portions of said first set of contacts, each slot for receiving therein a lead which can electrically connect the stem portion of one of said first set of contacts to the corresponding stem portion of said second set of contacts; and a second set of slots formed in said bottom surface aligned with said terminal portions of said second set of contacts, each slot for receiving therein a lead which can electrically connect the stem portion of one of said first set of contacts to the corresponding stem portion of said second set of contacts.

19. The connector module according to claim 18, further comprising:

a spacer provided in said housing between corresponding stem portions of said first and second sets of contacts, wherein said spacer is formed of an electrically insulating material and insures that facing stem portions of said first and second sets of contacts do not make electrical contact with each other.

20. The connector module according to claim 19, wherein said spacer is a part of said housing.

21. A connector module comprising:

a housing;

first and second sets of contacts mounted within said housing, each contact including a terminal portion which is capable of providing electrical connection to a corresponding wire and a stem portion, said contacts being mounted so that each stem portion of said first set of contacts faces a corresponding stem portion of said second set of contacts without making electrical contact with the corresponding stem portion of said second set of contacts; and a first set of slots formed in said housing, each slot for receiving therein a lead which can electrically connect the stem portion of one of said first set of contacts to the corresponding stem portion of said second set of contacts.

* * * * *